US006620033B2

(12) United States Patent
Barton, II

(10) Patent No.: US 6,620,033 B2
(45) Date of Patent: Sep. 16, 2003

(54) THRUSTWALL POLISHING ASSEMBLY

(76) Inventor: Kenneth A. Barton, II, 1305 S. Cedar Suite 506, Lansing, MI (US) 48910

( * ) Notice: Subject to any disclaimer, the term of this patent is extended or adjusted under 35 U.S.C. 154(b) by 65 days.

(21) Appl. No.: 09/827,862

(22) Filed: Apr. 6, 2001

(65) Prior Publication Data

US 2002/0146968 A1 Oct. 10, 2002

(51) Int. Cl.[7] ..... B24B 7/17
(52) U.S. Cl. ..... 451/173; 451/317
(58) Field of Search ..... 451/313, 173, 451/63, 49, 168, 317, 504, 505

(56) References Cited

U.S. PATENT DOCUMENTS

| | | | | | |
|---|---|---|---|---|---|
| 1,993,543 | A | * | 3/1935 | Egger | 451/49 |
| RE31,593 | E | * | 6/1984 | Judge, Jr. | 451/173 |
| 5,803,796 | A | * | 9/1998 | Barton, II | 451/173 |
| 6,283,838 | B1 | * | 9/2001 | Blake et al. | 451/173 |

FOREIGN PATENT DOCUMENTS

| | | | | |
|---|---|---|---|---|
| DE | 4024655 | * | 2/1992 | 451/49 |
| SU | 1333551 | * | 8/1987 | 451/49 |

* cited by examiner

*Primary Examiner*—Robert A. Rose

(57) ABSTRACT

A thrustwall surface polishing tool for use with a power means for rotating a workpiece about an axis for treating a workpiece thrustwall surface.

9 Claims, 6 Drawing Sheets

THRUSTWALL POLISHING ASSEMBLY

TECHNICAL FIELD

This invention relates generally to metal surface finishing and more particularly to an apparatus for microfinishing metal surfaces on various machine components such as the thrustwall of a crankshaft.

BACKGROUND OF THE INVENTION

"Microfinishing", "Micropolishing" or "superfinishing", as it is known in the art, is a surface finishing process wherein a grinding means is brought to bear against a workpiece which has been previously rough ground. Microfinishing is a low velocity abrading process which generally follows rough grinding. Because microfinishing incorporates lower cutting speeds than grinding, heat and pressure variants may be minimized to provide improved size and geometry control. Those skilled in the art recognize that surface quality or roughness is measured in roughness average values ($R_a$) wherein $R_a$ is the arithmetical average deviation of minute surface irregularities from hypothetical perfect surfaces. Microfinishing can provide surface quality of approximately 1 to 10 $\mu$in. (0.025 to 0.25 $\mu$m). Bearing or thrustwall surfaces of crankshafts, cam shafts, power transmission shafts in similar machine components that rotate on journal bearing surfaces generally require this surface finish for satisfactory operation.

Microfinishing processes are used in automotive applications in the manufacture, repair and rebuilding of internal combustion (IC) engines and well as original manufacturing, rework, rebuild and performance enhancement applications. Such engines not only require finely finished thrustwall area and bearing area surfaces for engine efficiency, but also for increased durability and longevity. In the initial manufacturing stage, crankshaft and camshaft bearing surfaces are microfinished to particular roughness specifications by previously mentioned, conventional mass production microfinishing machines.

In the repair or rebuilding stages, engine components such as crankshafts and cam shafts from faulty engines or older engines, are removed and reground to remove ten to thirty-thousandths of an inch of stock from the existing bearing surfaces. For thrustwall applications, the removal may be from 0.0001 to 0.005 inches and in some operations up to 0.20 inches off each wall. The bearing surfaces of these components are then polished or microfinished by placing the respective workpieces on a lathe and manually bringing a microfinishing material in contact with the rotating bearing surfaces. This microfinishing material is often a section of abrasive material mounted on a support correspondingly shaped to the bearing surface. It is generally recognized in the industry that these manual finishing operations are inadequate for achieving finished surfaces of standard quality.

Automotive repair and rebuilding operations microfinish very low volumes of engine components with respect to standard manufacturing operations. Special purpose crankshaft finishing machines such as disclosed in U.S. Pat. No. Re. 31,593 to Judge, Jr., reissued Jun. 5, 1984, are designed for low and medium volume workpiece production. These manufacturing machines are expensive and inappropriate for very low volume workpiece production or repair. Finishing machines of the type disclosed in the Judge, Jr. patent require programming of a computer controller for each different workpiece that requires finishing.

Automotive repair and rebuilding operations reclaim and refinish workpieces from hundreds of various internal combustion engines with different designs. Programmably controlling a finishing machine to accept each individual workpiece that requires microfinishing from different internal combustion engines is uneconomical and inefficient.

As discussed above, thrustwall surfaces also require a surface quality or surface finish equal to that of a bearing surface. As the thrustwall surface is found on opposing walls of the crankshaft body, it is typically relatively narrow. This area between the thrustwall surfaces, in common automotive engines is between 0.75 inches and 3.00 inches. The thrustwall surface polishing unit must be capable of insertion into this narrow area and function as a finishing tool. More specifically, pressure must be applied and released to the opposing thrustwall surfaces to allow for placement of the thrustwall surface polishing tool, polishing of the areas while rotations is occurring and removal of the thrustwall tool after polishing.

A thrustwall polishing unit must be able to quickly and consistently expand and retract over time. Further this expansion and contraction will occur every time a new part is polished. Prior art methods employ a metal springs or rubber o-rings to effectuate the retraction function for the thrustwall polishing unit. A reliable, long lasting retraction means is needed by the industry.

SUMMARY OF THE INVENTION

The thrustwall surface polishing assembly of the present invention has been developed to meet the need for an automatic or a manually controlled, low volume thrustwall microfinishing machine that is capable of achieving finished surfaces of consistent quality on selected surfaces. The thrustwall surface polishing assembly has the versatility to accept many various families of crankshafts and other workpieces needing thrustwall polishing without the need for programming of control sequences.

The present invention is also uniquely capable of serving as a manufacturing repair machine for correcting thrustwall surfaces on machine components previously microfinished by large, high volume microfinishing machines or as a very low volume microfinishing machine for automotive service repair and rebuilding operations.

The polishing assembly includes a polishing body. The polishing body is attached to a base which is movable with respect to the workpiece along the axis of rotation of the workpiece.

In operation, the polishing assembly has an indexing polishing tape which is manually indexable. This manual indexing affords accurate and rapid operation and also allows for the accommodation of many families of machine components. Automatic indexing is also accomplished with an automatic machine system. The microfinishing machine operates without the need for time-consuming and expensive pre-programming of numerical control systems needed to index and operate automotive microfinishing machines. Automatic indexing is also accomplished with an automatic machine system.

It is a still further object of the present invention to provide an improved thrustwall surface polishing machine including a surface polishing assembly that is inexpensive to manufacture and operate in medium and low volume production microfinishing processes.

It is a further object of the present invention to provide a thrustwall surface polishing tool having an elongate body section, an actuating arm located adjacent the elongate body section, a first wedge connected to the first movable actuating arm, a second wedge, and a polishing shoe disposed adjacent to both the first and second wedges wherein a retraction of the actuating arm causes the polishing shoe to extend out away from the elongate body section and an extension of the actuating arm causes the polishing shoe to retract in toward the polishing body.

It is yet another object of the present invention to provide a thrustwall surface polishing tool capable of improving parallelism.

It is yet another object of the present invention to provide a thrustwall surface polishing tool for use with a power means for rotating a workpiece about an axis comprising an elongate body section having an inner cavity, an actuating arm located inside the elongate body section inner cavity, the actuating arm having a first extending key member and a second extending key member, a stationary arm located adjacent the actuating arm, a biasing means for moving the actuating arm from between an extended position to a retracted position, a first wedge connected to the actuating arm, a second wedge connected to the stationary arm, and a polishing shoe disposed adjacent both the first and second wedges, the polishing shoe having a first keyway for accepting the first key member and a second keyway for accepting the second key member wherein moving the actuating arm to the retracted position causes the polishing shoe to extend out away from the elongate body section to a polishing position and moving the actuating arm to an extended position causes first key member to engage the first keyway and the second key member to engage the second keyway thereby mechanically retracting the polishing shoe in toward the polishing body to a transfer position.

A more specific object of the present invention is to provide a thrustwall surface polishing tool including first and second polishing shoes disposed directly opposite each other and mechanically retractable without the use of 'O' rings or springs.

The above objects and other objects, features and advantages of the present invention are readily apparent from the following detailed description of the best mode for carrying out the invention to be taken in connection with the accompanying drawings.

DETAILED DESCRIPTION OF THE INVENTION

Figure 1:
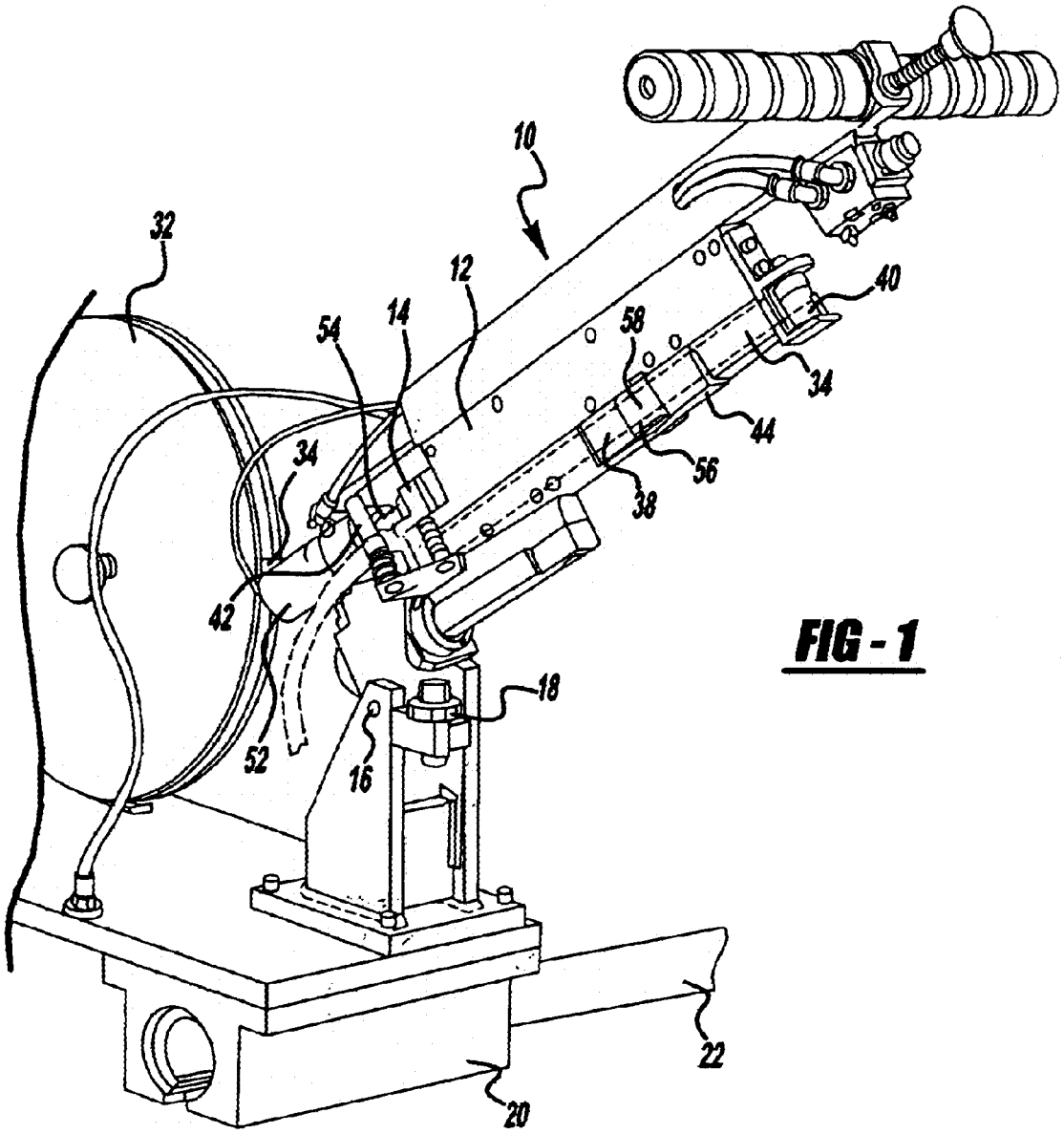
FIG. 1 is a perspective view of the thrustwall surface polishing tool of the present invention.

With reference to FIG. 1, a thrustwall surface polishing tool of the present invention is shown generally designated by reference numeral 10. Thrustwall surface polishing tool 10 includes an elongate body section 12. A drawbar or first actuating arm 14 extends through a portion of elongate body section 12. More specifically, actuating arm 14 extends through inner cavity 13. The thrustwall surface polishing tool 10 is pivotable about pin 16. Positive stop 18 is adjustable and may be set to support the thrustwall surface polishing tool 10 at various heights.

Figure 2:
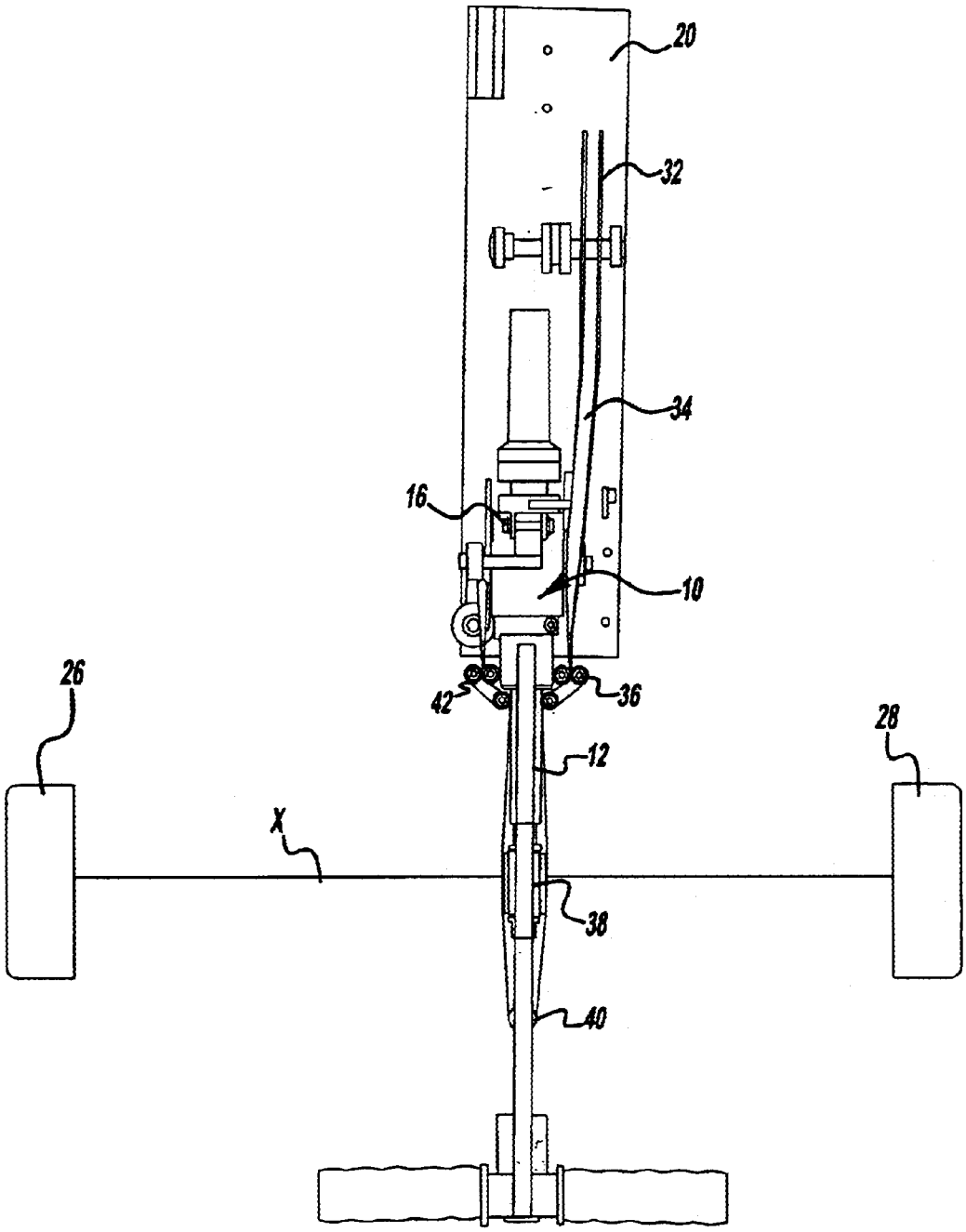
FIG. 2 is a top view of the thrustwall surface polishing tool of the present invention.
Figure 3:
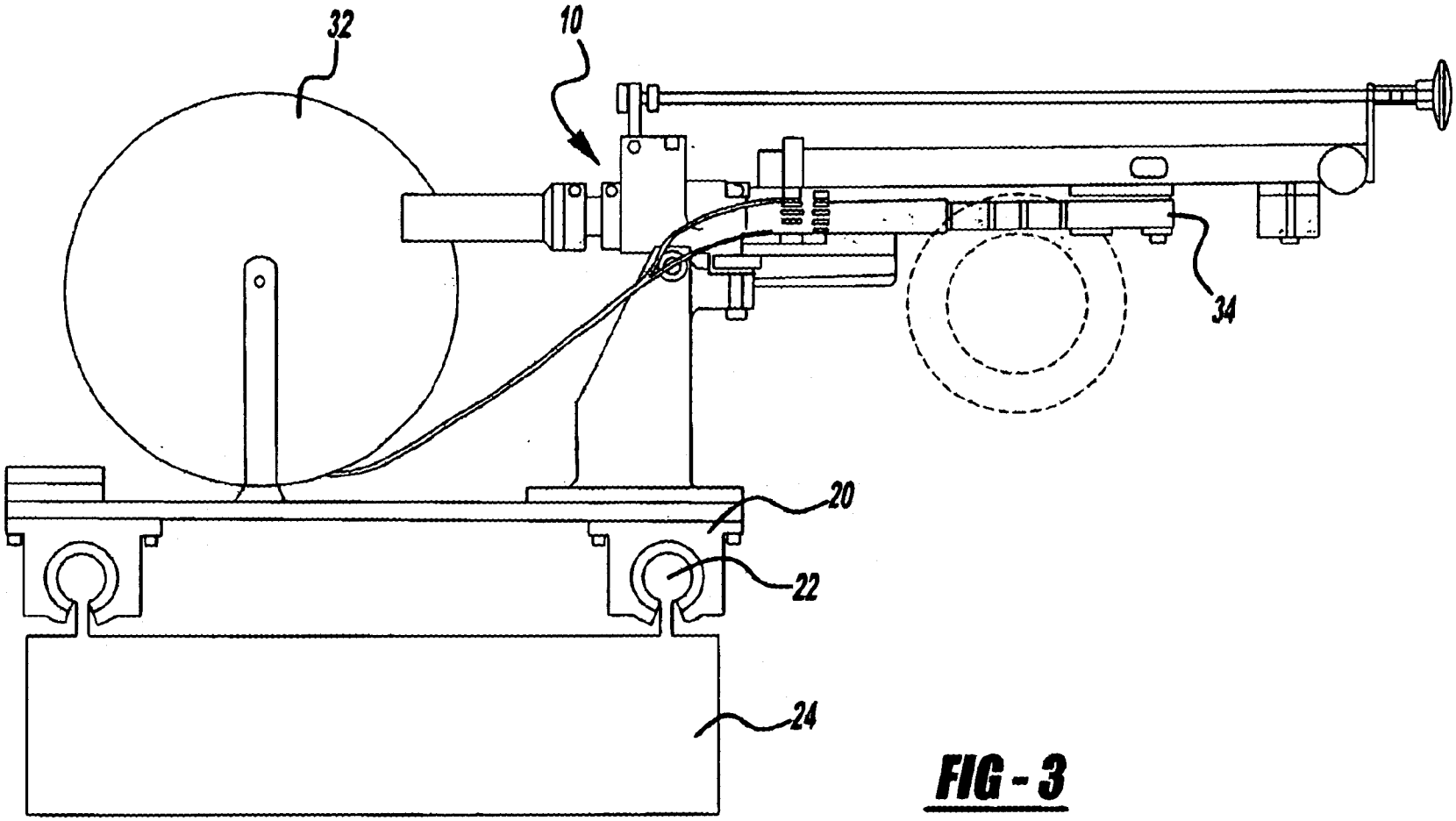
FIG. 3 is a side view of the thrustwall surface polishing tool of the present invention.

Thrustwall surface polishing tool 10 is affixed to sliding base 20. Sliding base 20 is movable along tracks 22. Tracks 22 are connected to a table 24 as shown in FIG. 3. Referring to FIG. 2, a headstock 26 and a tailstock 28 a used to rotate crankshaft 30 about an axis X. A power means, such as the headstock 26 and tailstock 28, for rotating the crankshaft about its axis X is contemplated by the present invention.

Referring back to FIGS. 1 and 2, there is shown a microfinishing tape reel 32 having loaded a microfinishing tape 34 (shown in phantom in FIG. 1). Microfinishing tape 34 travels from reel 32 through a side guides 36, past polishing shoe 38, around center guide 40 and through opposing side guides 42. The thrustwall surface polishing tool 10 uses manual indexing of the micropolishing tape 34. This manual indexing affords accurate and rapid operation and also allows for the accommodation of many families of machine components. The thrustwall surface polishing tool 10 of the present invention operates without the need for time-consuming and expensive pre-programming of numerical control systems needed to index and operate automotive microfinishing machines. Polishing shoe 38 includes a urethane insert for use in supporting the micropolishing or indexing polishing tape during polishing.

Figure 4:
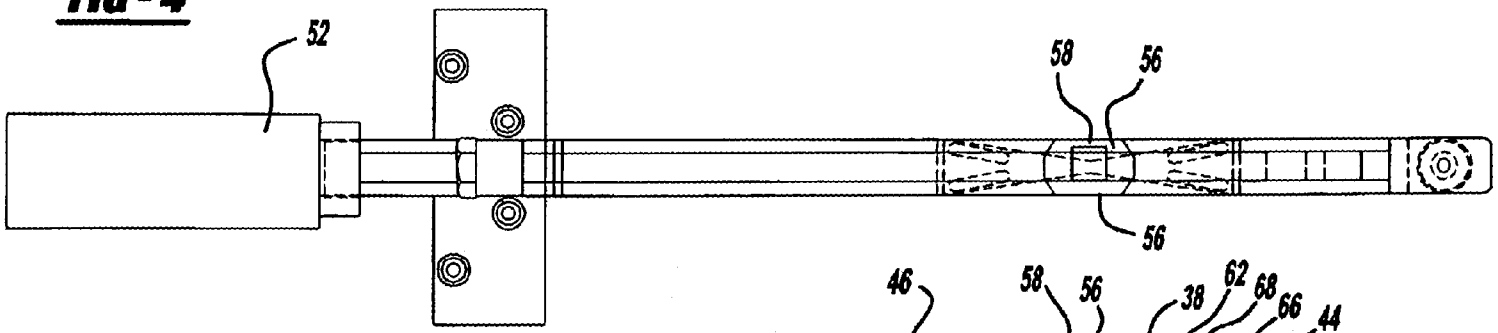
FIG. 4 is a top view of the thrustwall surface polishing tool of the present invention.
Figure 4A:
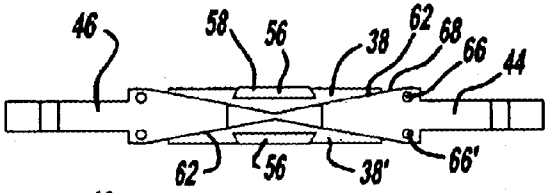
FIG. 4*a* is a partial bottom view of the polishing shoes and polishing wedges of the present invention.
Figure 5:
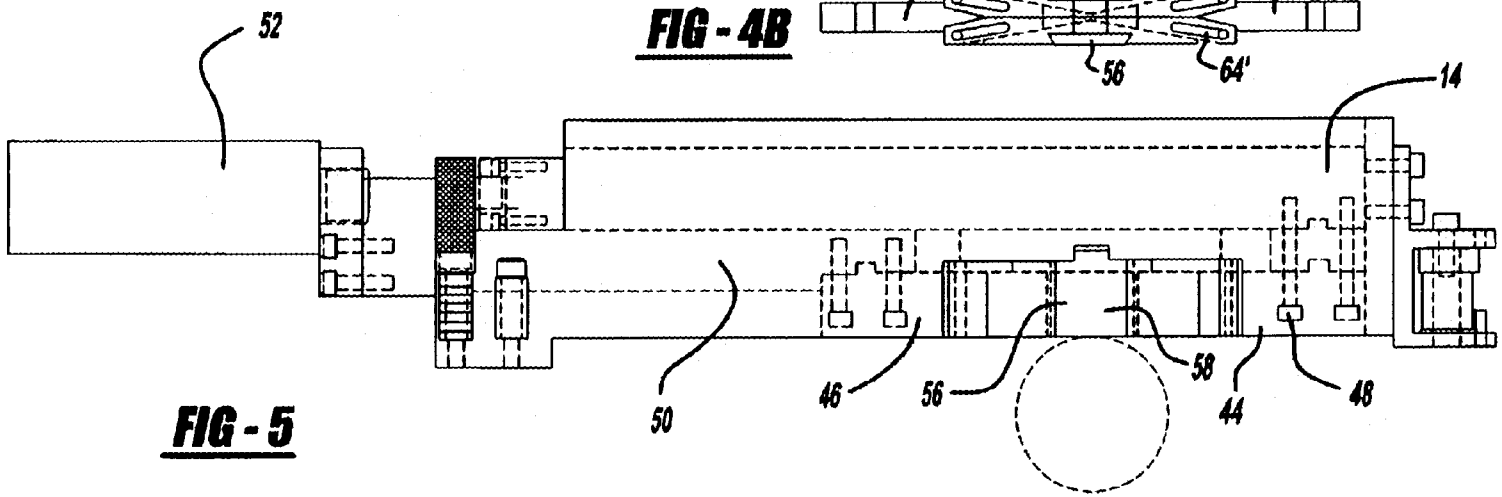
FIG. 5 is a partial side view of the thrustwall surface polishing tool of the present invention.
Figure 6:
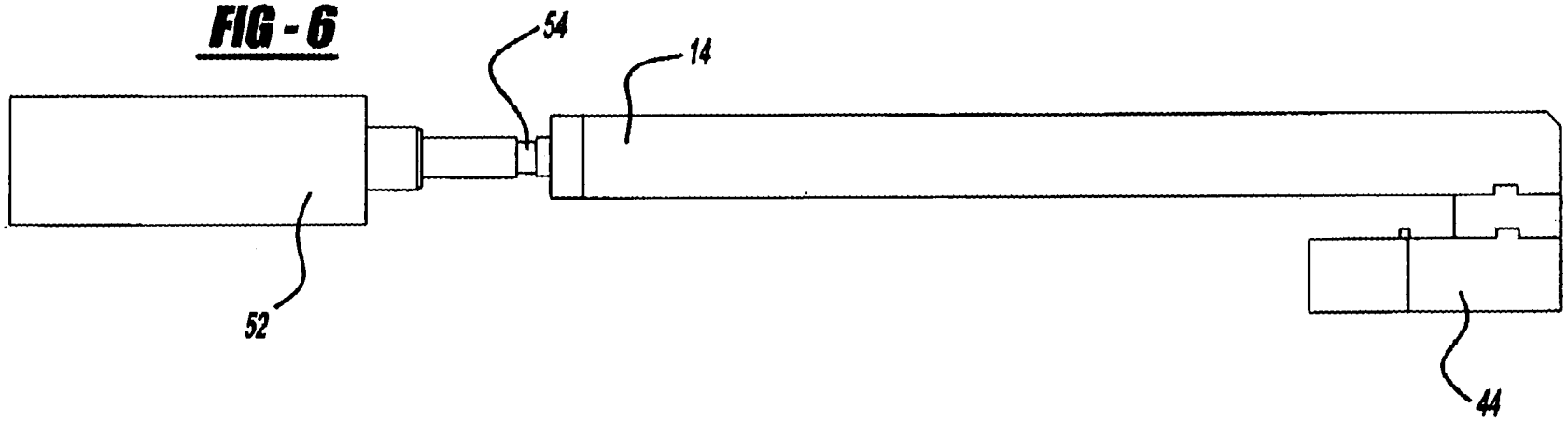
FIG. 6 is a partial side view of the thrustwall surface polishing tool of the present invention illustrating the first actuating arm.
Figure 7:
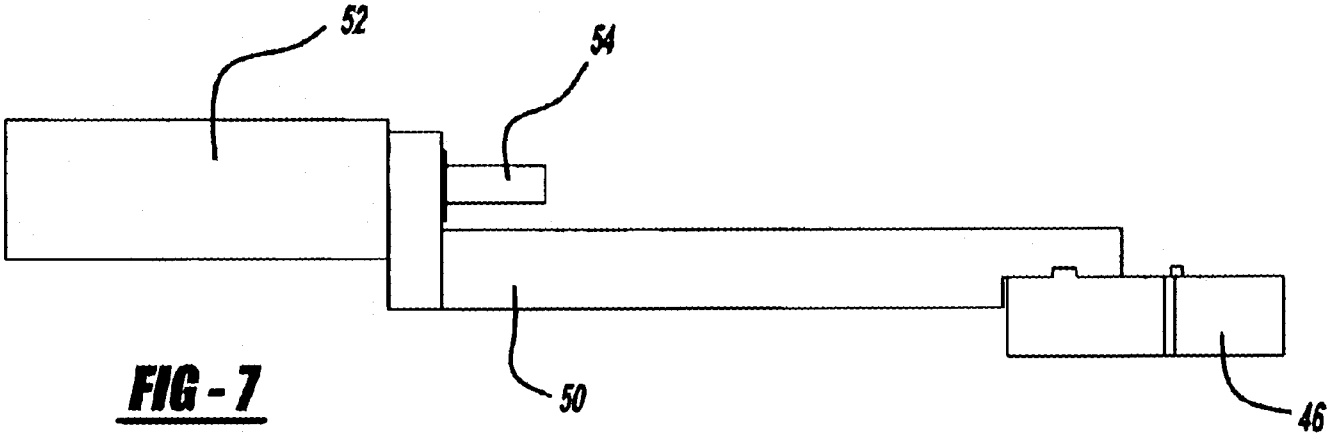
FIG. 7 is a partial side view of the thrustwall surface polishing tool of the present invention illustrating the second actuating arm.

As shown in FIG. 4, a first wedge 44 is disposed adjacent said polishing shoe 38. Second wedge 46 is disposed directly opposite first wedge 44. First wedge 44 is affixed to first actuating arm 14, as shown in FIG. 6, such that movement of the first actuating arm results in proportional movement of first wedge 44. Bolts 48 connect first wedge 44 to first actuating arm 14 as shown in FIG. 5. Second wedge 46 is affixed to a second actuating arm 50. Referring to FIG. 6, biasing means or biasing cylinder 52 is connected to first actuating arm 14. Biasing cylinder 52, in the preferred embodiment, is a common pneumatic cylinder capable of applying a pressure in a range from 0 to 250 pounds per square inch. Biasing cylinder 52 includes a rod 54 which is affixed to actuating arm 14. Thus operation of the biasing cylinder 52 by movement of the rod 54 actuates or moves the actuating arm 14 which in turn moves first wedge 44.

Referring to FIGS. 4, 4*a*, 4*b*, and 5, polishing shoe 38 includes a pair of polishing inserts 56. Polishing inserts 56 have a generally planar, flat surface 58 which is used to support polishing tape 34 as shown in 8. Polishing insert, in the preferred embodiment is made of urethane.

Figure 4B:
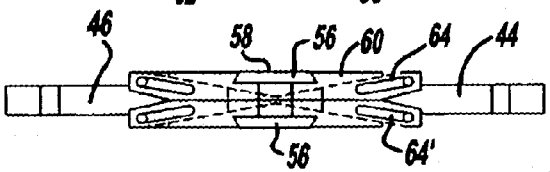
FIG. 4*b* a partial top view of the polishing shoes and polishing wedges of the present invention.
Figure 8:
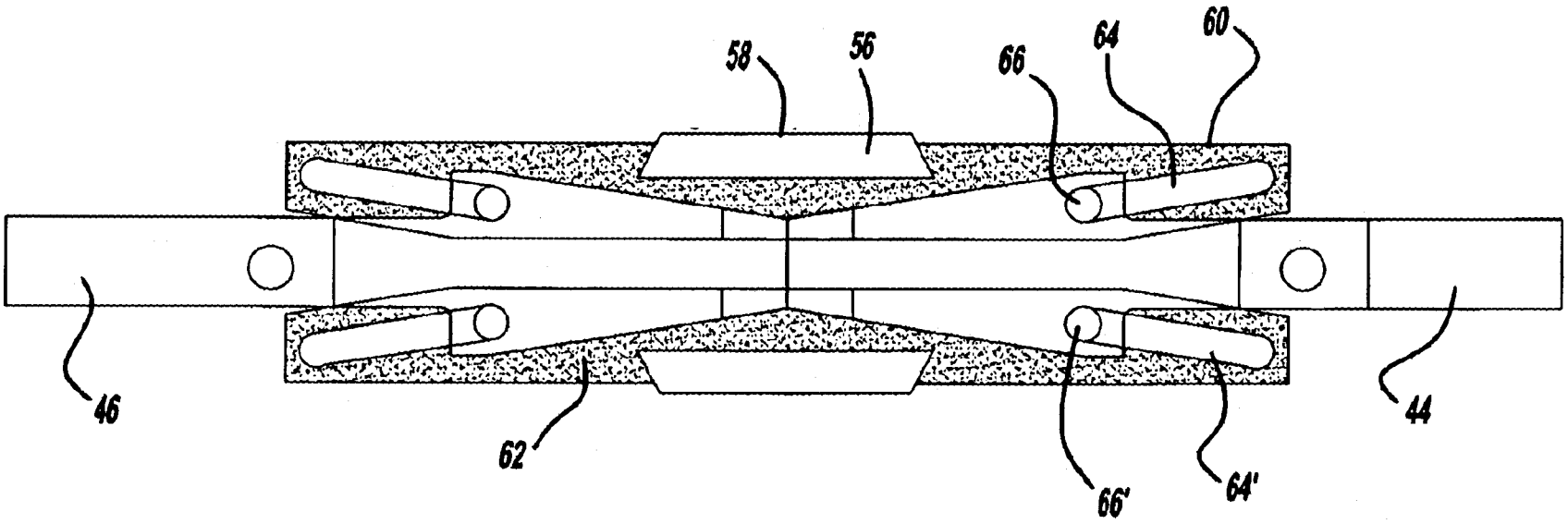
FIG. 8 an enlarged partial top view of the polishing shoes and polishing wedges of the present invention.

Polishing shoe 38 includes a top shoulder section 60, as shown in FIGS. 4*b* and 8, which extends out from wedge contact surface 62. Top shoulder section 60 includes a slot 64. First actuating arm 14 further includes a pin 66 which extends down toward polishing shoe 38 as shown in FIG. 6. A like pin 66' and slot 64' arrangement is located on the opposite side of polishing shoe 38. It is also contemplated by the present invention to use any form of extending key member or extending pin in place of pins 66 and 66' as well as cooperating keyways or slots 64 and 64' to accept and guide the extending pins or key members. Any form of cooperating extending member and receiving slot or keyway may be used to guide the wedges.

Attention is now turned to the operation of the thrustwall surface polishing tool 10. Polishing shoe 38 is disposed adjacent both first wedge 44 and second wedge 46. A retraction of first actuating arm 14 and second actuating arm 50 causes polishing shoe 38 to extend out away from elongate body section 12. An extension of the actuating arms causes pins 66 and 66' to engage slots 64 and 64' respectively and to mechanically retract polishing shoe 38 to retract in toward elongate body section. The distance the polishing insert 38 is moved is in a range from 0 mm to 6 mm. More specifically, with the polishing shoe 38 disposed adjacent both the first and second wedges 44 and 46, and the polishing shoe slot 64 accepting the pin member 66 and slot 64' accepting the pin member 66, the movement of the actuating arms 14 and 50 to the retracted position causes the polishing shoe 38 to extend out away from the elongate body section 12 to a polishing position. Subsequent movement of the actuating arms 14 and 50 to a retracted position causes pin member 66 to engage slot 64 and pin member 66' to engage slot 64' thereby mechanically retracting the polishing shoe in toward the elongate body section 12 to a transfer position.

First wedge 44 and second wedge 46 include a shoe contact surface 68 and polishing shoes 38, as described above and further include a complimentary wedge contact surfaces 62. A predefined lateral movement of first wedge 44 and second wedge 46 causes contact between shoe contact surface 68 and wedge contact surface 62 thereby causing polishing shoe 38 to extend out away from elongate body section 12. The polishing shoe is left in the polishing position for a predefined time period applicable to the specific crankshaft surface and surface quality desired.

The thrustwall surface polishing assembly 10 of the present invention has been developed to meet the need for a manually controlled, low volume thrustwall microfinishing system, that is capable of achieving finished surfaces of consistent quality on selected surfaces. The thrustwall surface polishing assembly 10 of the present invention has the versatility to accept many various families of crankshafts and other workpieces requiring thrustwall polishing without the need for programming of control sequences.

While the best mode for carrying out the invention has been described in detail, those familiar with the art to which this invention relates will recognize various alternative designs and embodiments for practicing the invention as defined by the following claims.

What is claimed is:

1. A thrustwall surface polishing tool for use with a power means for rotating a workpiece about an axis comprising:

an elongate body section;

an actuating arm located adjacent said elongate body section;

a first wedge connected to said first actuating arm;

a second actuating arm;

a second wedge connected to said second actuating arm;

a polishing shoe disposed adjacent both said first and second wedges wherein a retraction of said actuating arms causes said polishing shoe to extend out away from said elongate body section and an extension of said actuating arms causes said polishing shoe to retract in toward said elongate body section; and a polishing tape disposed adjacent said polishing shoe for polishing said workpiece.

2. The thrustwall surface polishing tool of claim 1 further including a second polishing shoe disposed directly opposite said first polishing shoe.

3. The thrustwall surface polishing tool of claim 1 wherein said first wedge includes a shoe contact surface and said polishing shoe includes a complimentary wedge contact surface and a predefined lateral movement of said first wedge cause contact between said shoe contact surface and said wedge contact surface thereby causing said polishing shoe to extend out away from said elongate body section.

4. A thrustwall surface polishing tool for use with a power means for rotating a workpiece about an axis comprising:

an elongate body section having an inner cavity;

an first actuating arm located inside said elongate body section inner cavity, said actuating arm having a first extending pin member and a second extending pin member;

a second actuating arm located adjacent said first actuating arm;

a biasing means for moving said actuating arm from between an extended position to a retracted position;

a first wedge connected to said actuating arm;

a second wedge connected to said stationary arm;

a polishing shoe disposed adjacent both said first and second wedges, said polishing shoe having a first slot for accepting said first pin member and a second slot for accepting said second key pin wherein moving said first actuating arm to said retracted position causes said polishing shoe to extend out away from said elongate body section to a polishing position and moving said first actuating arm to an extended position causes first pin member to engage said first slot and said second pin member to engage said second slot thereby mechanically retracting said polishing shoe in toward said elongate body section to a transfer position; and a polishing tape disposed adjacent said polishing shoe for polishing said workpiece.

5. A thrustwall surface polishing tool for use with a power means for rotating a workpiece about an axis comprising:

an elongate body section;

a first actuating arm located adjacent said elongate body section, said first actuating arm having a first extending key member and a second extending key member;

a first wedge connected to said first actuating arm;

a second actuating arm;

a second wedge connected to said second actuating arm;

a polishing shoe disposed adjacent both said first and second wedges, said polishing shoe having a first keyway for accepting said first key member and a second keyway for accepting said second key member wherein a retraction of said actuating arm causes said polishing shoe to extend out away from said elongate body section and an extension of said actuating arm causes said first key member to engage said first keyway and said second key member to engage said second keyway mechanically retracting said polishing shoe in toward said elongate body section; and a polishing tape disposed adjacent said polishing shoe for polishing said workpiece.

6. The thrustwall surface polishing tool of claim 5 further including a second polishing shoe disposed directly opposite said first polishing shoe.

7. The thrustwall surface polishing tool of claim 5 wherein said first wedge includes a shoe contact surface and said polishing shoe includes a complimentary wedge contact surface and a predefined lateral movement of said first wedge cause contact between said shoe contact surface and said wedge contact surface thereby causing said polishing shoe to extend out away from said elongate body section.

8. The thrustwall surface polishing tool of claim 4 further including a second polishing shoe disposed directly opposite said first polishing shoe.

9. The thrustwall surface polishing tool of claim 4 wherein said first wedge includes a shoe contact surface and said polishing shoe includes a complimentary wedge contact surface and a predefined lateral movement of said first wedge cause contact between said shoe contact surface and said wedge contact surface thereby causing said polishing shoe to extend out away from said elongate body section.

* * * * *